US006550643B1

(12) United States Patent
Foster et al.

(10) Patent No.: US 6,550,643 B1
(45) Date of Patent: Apr. 22, 2003

(54) DISPENSER FOR VISCOUS FLUIDS

(76) Inventors: Gordon Brian Foster, 104 Woodside Place, Airdrie, Alberta (CA), T4B 2E3; Nyansa Alberta VanVonno, 104 Woodside Place, Airdrie, Alberta (CA), T4B 2E3

( * ) Notice: Subject to any disclaimer, the term of this patent is extended or adjusted under 35 U.S.C. 154(b) by 2 days.

(21) Appl. No.: 10/020,875

(22) Filed: Dec. 19, 2001

(51) Int. Cl.[7] ..... B67D 5/08

(52) U.S. Cl. ..... 222/63; 222/256; 222/333; 222/334; 222/340; 222/390

(58) Field of Search ..... 222/146.1, 261, 222/262, 266, 334, 326, 383, 389, 333, 63, 390, 256, 340

(56) References Cited

U.S. PATENT DOCUMENTS 3,601,285 A * 8/1971 Leger ..... 222/334
3,758,003 A * 9/1973 Kautz et al. ..... 222/146.1
3,976,229 A * 8/1976 Jackson ..... 222/146.1
3,982,669 A * 9/1976 Moore ..... 222/146.1
4,090,640 A * 5/1978 Smith et al. ..... 222/146.1
4,635,820 A * 1/1987 Marshall ..... 222/334
4,693,286 A * 9/1987 Lock et al. ..... 222/389
4,790,456 A * 12/1988 Nakane et al. ..... 222/386
5,170,710 A 12/1992 Harpold et al.
5,275,100 A 1/1994 Harpold et al.
5,312,028 A * 5/1994 Hume ..... 222/326
6,046,437 A * 4/2000 Frates ..... 222/146.1

* cited by examiner

*Primary Examiner*—Henry C. Yuen
*Assistant Examiner*—M A Cartagena
(74) *Attorney, Agent, or Firm*—Santosh K. Chari; Orange and Chari

(57) ABSTRACT

A dispenser for viscous fluids such as plastisol inks includes a frame, a plunger mechanism having a plunger that is adapted to engage a container containing the fluid, and a drive mechanism for vertically advancing the plunger into the container. The plunger includes a central opening attached to a hose for dispensing the fluid in the desired quantities.

18 Claims, 8 Drawing Sheets

DISPENSER FOR VISCOUS FLUIDS

BACKGROUND OF THE INVENTION

1. Field of the Invention

The present invention relates to apparatus for dispensing viscous fluids such as plastisol inks.

2. Description of the Prior Art

Viscous fluids are commonly used in many commercial applications. Examples of such fluids include thermoplastic materials, lubricants and inks such as plastisol ink. Such fluids are, however, quite difficult to work with due to problems associated with pouring and handling. In the case of plastisol inks, for example, the fluid is very viscous and does not pour easily. Furthermore, the inks will adhere, or stick, to most surfaces.

Attempts at dispensing materials such as plastisol inks quite often result in many complications. Firstly, the inks are normally purchased in containers such as buckets etc. In order to dispense the material in an automated manner, the containers must usually be emptied into a hopper or the like of a dispensing apparatus. Such transfer is associated with problems due to the "sticky" nature of the material. For example, due to the high cost of plastisol inks, the buckets of material must usually be scraped to minimize loss of material. Further, due to the highly viscous nature of plastisol inks, most pumping systems usually result in inconsistent spurting of the material.

Various dispensing systems for viscous fluids have been provided in the prior art. Examples of such systems include those taught in U.S. Pat. Nos. 4,635,820; 4,790,456; 5,170,710; and, 5,275,100. However, the known devices have various deficiencies. For example, in some cases, the viscous fluid requires transfer from its original container into a holding container. Such transfer, as discussed above, is quite difficult and often results in loss of material. In addition, the known devices often include complex pumping systems to handle the highly viscous nature of the fluid.

Thus, a need exists for a dispenser for viscous fluids, particularly plastisol inks, that overcomes the deficiencies inherent with the known devices.

SUMMARY OF THE INVENTION

In accordance with one embodiment, the present invention provides an apparatus for dispensing a viscous fluid, such as plastisol ink, from a generally cylindrical container containing such fluid, the apparatus comprising:

a frame including a base for supporting the container, and a platform, generally vertically separated from the base, for supporting a plunger mechanism;

the plunger mechanism including a plunger and a drive mechanism for advancing the plunger towards the container and for impinging on the fluid;

the plunger being adapted to sealingly engage the interior wall of the container; and, the plunger including an exit port there-through for allowing ejection of the fluid from the container as the plunger is advanced into the container.

In another embodiment, the present invention provides an apparatus for dispensing a viscous fluid, such as plastisol ink, from a generally cylindrical container containing such fluid, the apparatus comprising:

a frame including a base for supporting the container, and a platform, generally vertically separated from the base, for supporting a plunger mechanism;

the plunger mechanism including a plunger and a drive mechanism for advancing the plunger towards the container and for impinging on the fluid;

the plunger being adapted to sealingly engage the interior wall of the container; and, the plunger including an exit port there-through for allowing ejection of the fluid from the container as the plunger is advanced into the container;

wherein the drive mechanism includes one or more advancing arms each having first and second ends, the first ends being attached to the plunger and the second ends being attached to an advancing mechanism and wherein the advancing mechanism includes:

a threaded screw rod, secured in a generally vertical position to the frame and being rotatable about its central axis;

a nut having a correspondingly threaded aperture for engaging the screw rod and being capable of traversing along the length of the screw rod as the screw rod is rotated;

the nut being attached to the second ends of the advancing arms;

and a motor for rotating the screw rod;

whereby as the screw rod is rotated by the motor, the nut is raised or lowered.

In yet another embodiment, the invention provides an apparatus for dispensing a viscous fluid, such as a plastisol ink, from a generally cylindrical container containing such fluid, the apparatus comprising:

a frame means for supporting the container;

a plunger means, supported on the frame means, for applying pressure to the fluid in the container for forcing the fluid out of the container and through a port in the plunger means;

a drive means, supported on the frame means, for advancing the plunger means.

In yet another embodiment, the invention provides a system for dispensing a viscous fluid, such as plastisol ink, from a cylindrical container comprising a plurality of dispensing devices, each of the dispensing devices comprising:

a frame including a base for supporting the container, and a platform, generally vertically separated from the base, for supporting a plunger mechanism;

the plunger mechanism including a plunger and a drive mechanism for advancing the plunger towards the container and for impinging on the fluid;

the plunger being adapted to sealingly engage the interior wall of the container; and, the plunger including an exit port there-through for allowing ejection of the fluid from the container as the plunger is advanced into the container.

In another embodiment, the invention provides a plunger for use in dispensing a viscous fluid, such as plastisol ink, from a bucket, the plunger including:

a generally central exit port;

a funnel portion having a concave fluid contacting surface for directing the fluid to the exit port;

and an outer edge for sealingly engaging the interior walls of the bucket;

whereby, as the plunger is advanced into the bucket, the fluid is forced through the exit port.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

As will be described further below, the dispenser of the invention includes three main elements to dispense viscous fluids such as plastisol inks from a container: a frame to support all the components; a plunger system to force the fluid out of the container; and a drive system to actuate the plunger system.

Figure 1:
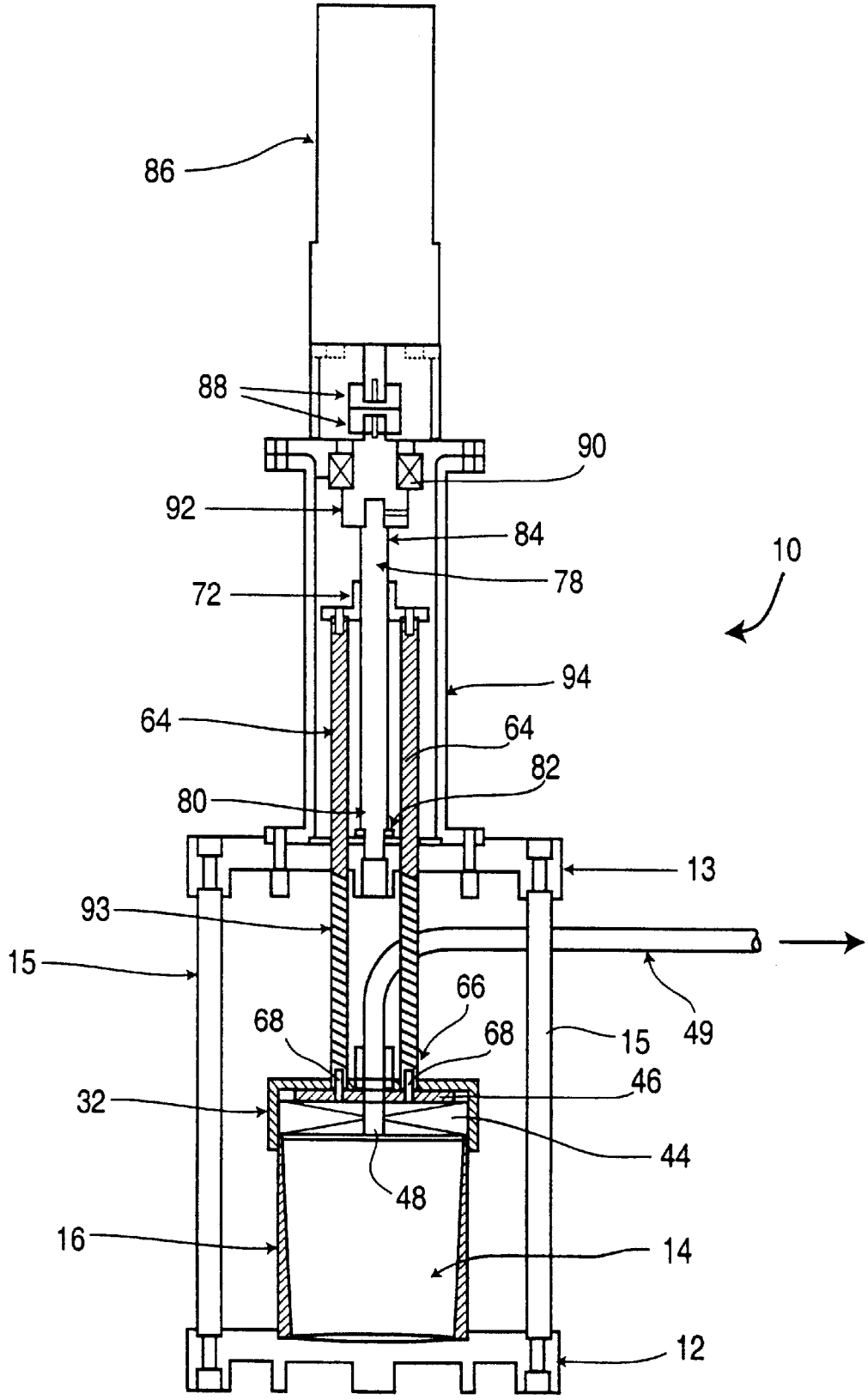
FIG. 1 is cross sectional elevation view of one embodiment of the dispenser of the invention.

FIG. 1 illustrates the dispensing apparatus of the invention generally indicated at 10. The dispenser 10 includes a frame comprising a base 12 and a top plate 13, the latter being separated vertically from the base 12 by means of spacers bars 15. The base 12 is adapted to support a container 14 containing the ink. In a preferred embodiment, the container comprises a generally cylindrical bucket in which the ink is supplied, for example a five gallon bucket or other size container. The dispenser of the present invention is adaptable for use with different sized containers.

In the preferred embodiment, a generally cylindrical sleeve 16 is provided around the container 14. As will be discussed further below, the sleeve 16 offers support for the container 14 during the dispensing process.

Figure 2:
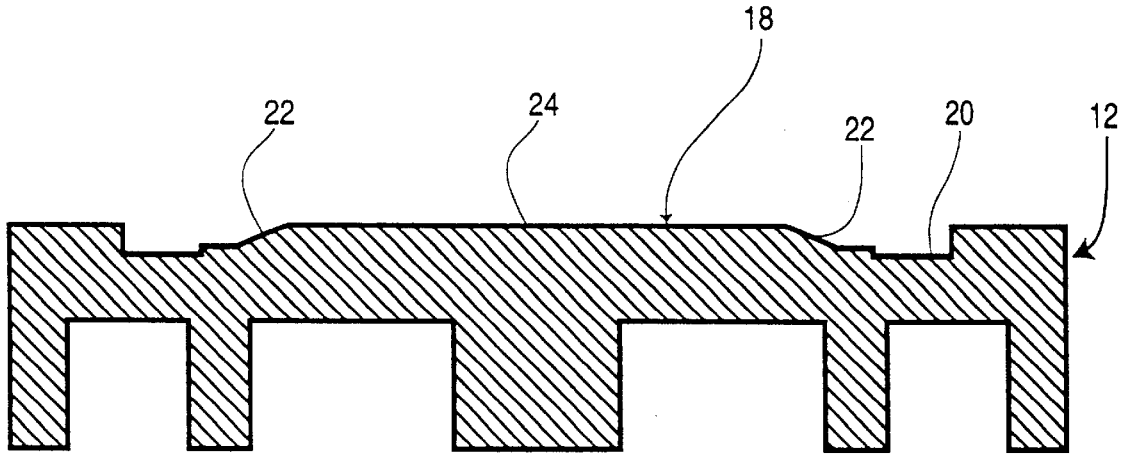
FIG. 2 is a cross sectional elevation of the base of the dispenser shown in FIG. 1.
Figure 3:
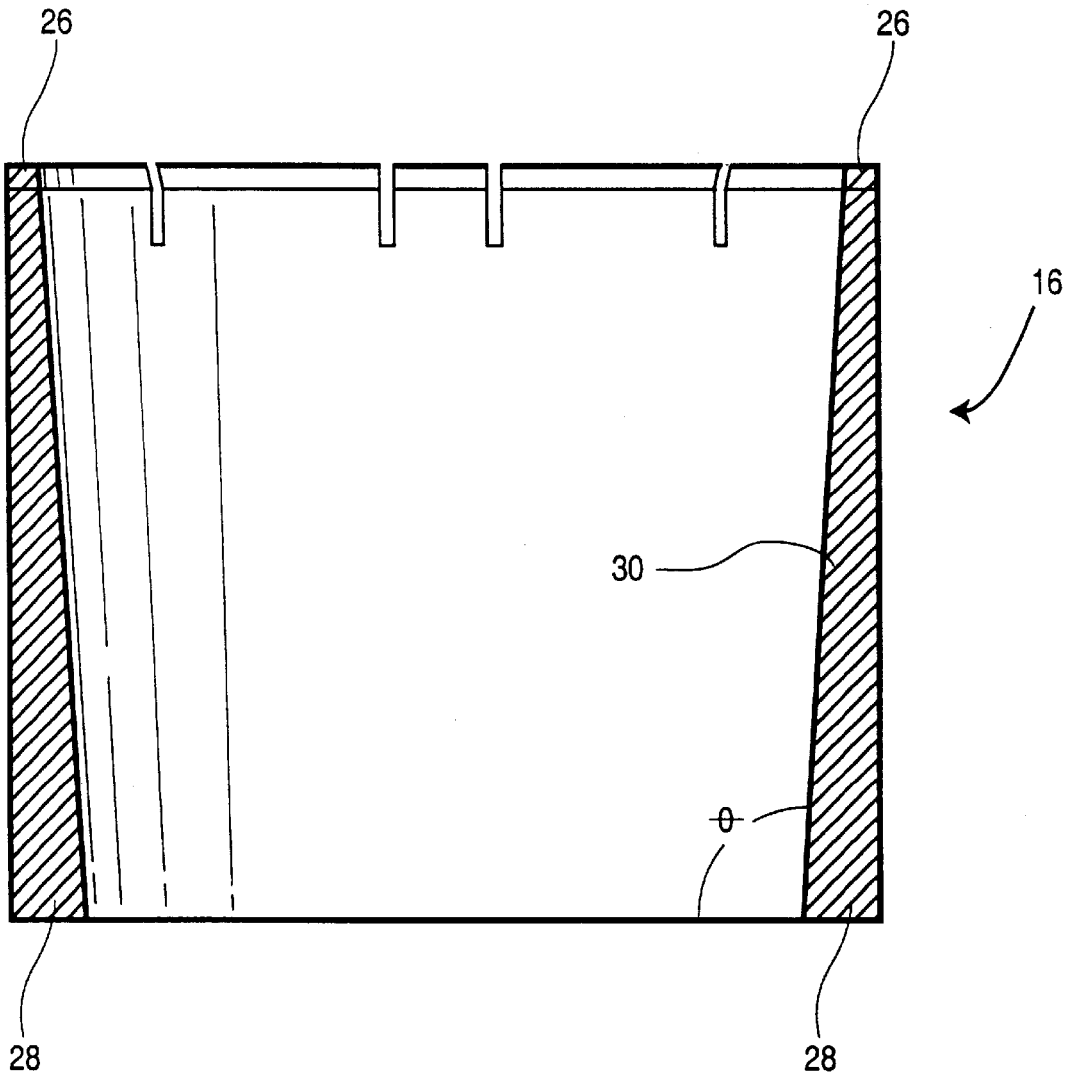
FIG. 3 is a cross sectional elevation of the container sleeve of the dispenser shown in FIG. 1.

The base 12 is illustrated in more detail in FIG. 2. As illustrated, in the preferred embodiment, the top surface 18 of the base 12 includes a circular race 20 for receiving the bottom end of the cylindrical sleeve 16. The base 12 also includes a circular bevel 22 defining a raised circular platform 24, which supports the container 14. Since the known containers comprise buckets with a generally concave bottom surface and a circumferencial bottom edge, the bevel 22 serves to position the container and maintain the container in place.

The sleeve 16 is illustrated in more detail in FIG. 2. As shown, the sleeve 16 comprises a cylinder having top 26 and bottom 28 ends. As indicated above, the bottom end 28 of the sleeve engages the race 20 of the base 12. The inner wall 30 of the sleeve 16 perferable includes a downward taper of an angle θ to accommodate the shape of the commonly known containers 14.

Figure 4:
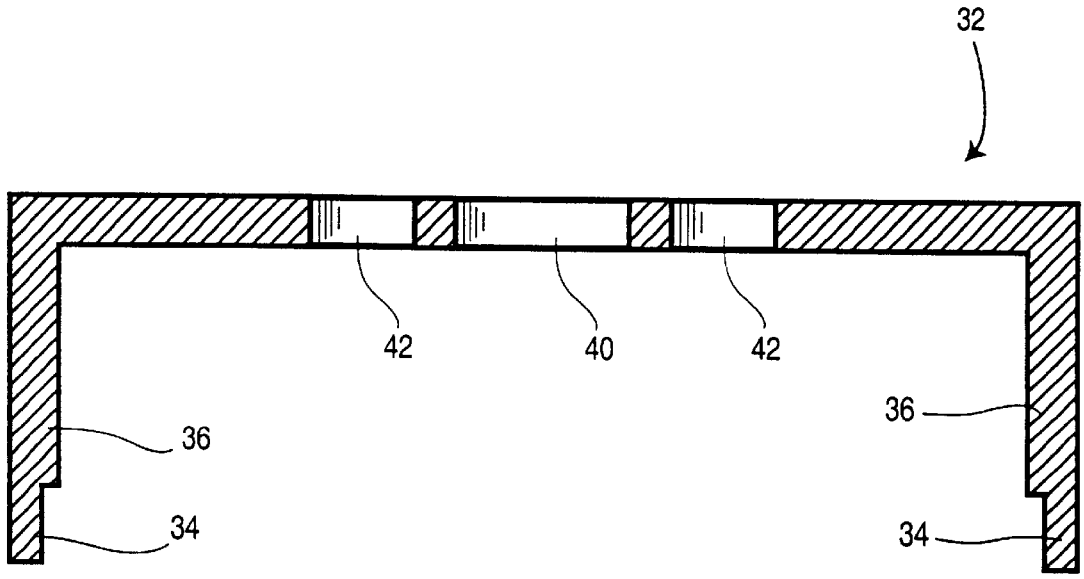
FIG. 4 is a cross sectional elevation of the container cap of the dispenser shown in FIG. 1.

Returning to FIG. 1, the dispenser 10 further includes a circular container cap 32 adapted to engage the top of the container 14. FIG. 4 illustrates the cap 32 in more detail. As indicated, the cap 32 has a generally inverted "U" shape in cross section. The cap includes a groove 34 on the bottom edge of the inner wall 36. The groove 34 serves to receive the upper edge of the container 14 and the sleeve 16. In the preferred embodiment, the width of the groove 34 corresponds with the width of the top edge of the container 14 and sleeve 16, whereby the surface of the inner wall 36 of the cap 32 is continuous with the opening of the container 14 as will be explained further below.

Figure 5:
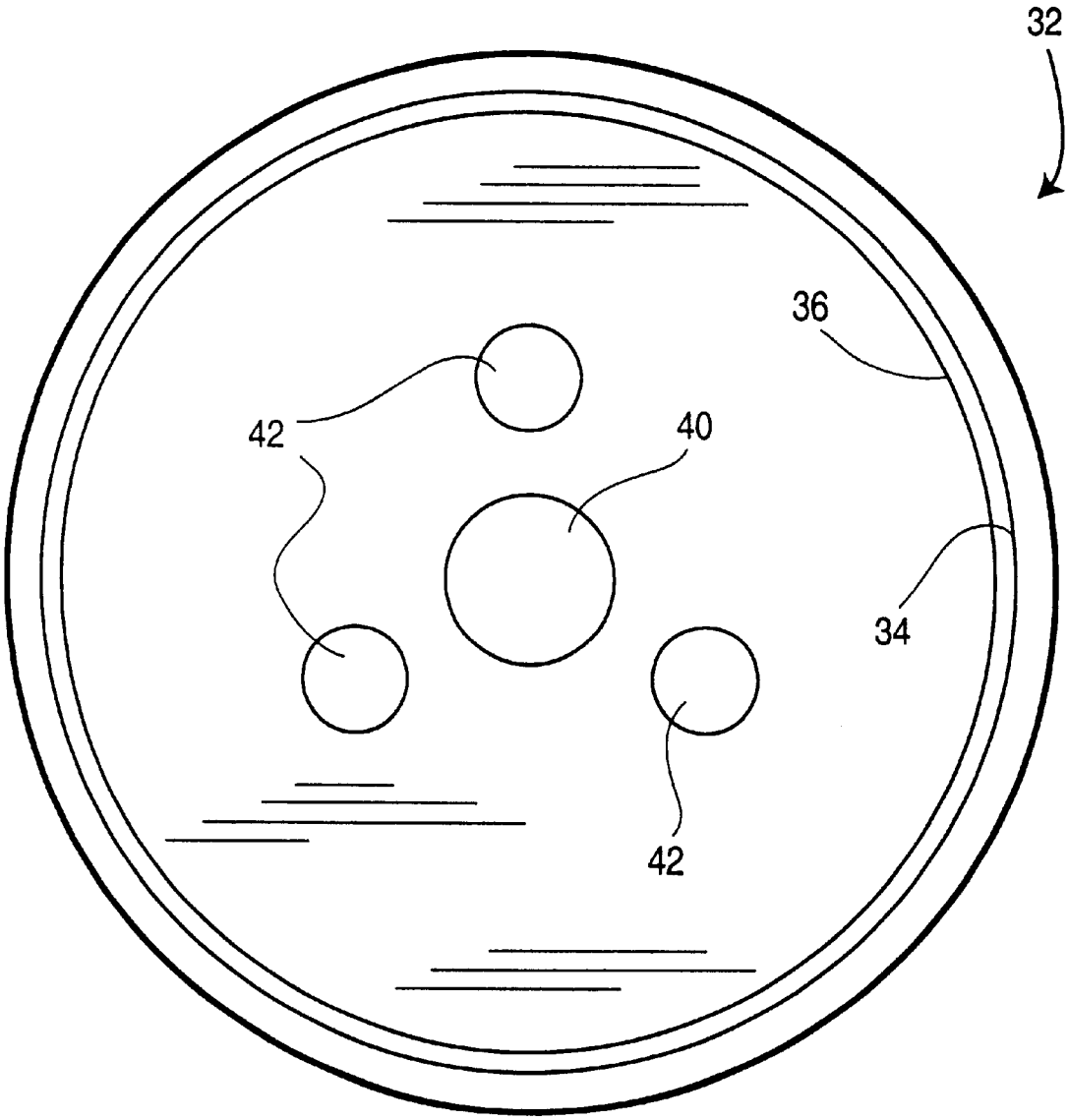
FIG. 5 is a bottom view of the container cap of the dispenser shown in FIG. 1.

The cap 32 further includes a number of apertures on the upper wall 38 thereof. Firstly, a central aperture 40 is provided, which comprises the outlet of the cap through which the ink is dispensed. A plurality of apertures 42 are provided to receive various push rods as will be described below. FIG. 5 illustrates a detail of the cap 32.

FIG. 1 also illustrates a plunger 44 and plunger plate 46 housed within the cap 32. The plunger 44 is sized to provide a tight seal between the outer edge thereof and the inner wall of the container 14. The plunger 44 can be made of any known material suitable for the present purpose and, in the preferred embodiment, is designed to change in diameter so as to adapt to the tapered side walls of the container 14. As indicated above, the surface of the inner wall 36 of the cap 32 is continuous with that of the opening of the container. As will be appreciated, this is a preferred way to avoid the outer edge of the plunger 44 from being caught by the upper edge of the container 14 when the plunger is advanced through the container.

The plunger includes a central aperture or exit port 48, which is coaxial with the central aperture 40 of the cap 32. The central aperture 48 is fluidly connected to a hose 49 through which the ink is dispensed. The bottom surface of the plunger 44 is preferably conical in shape, tapering upwards towards the central aperture 48, whereby flow of the ink into the hose 49 is facilitated.

Figure 6A:
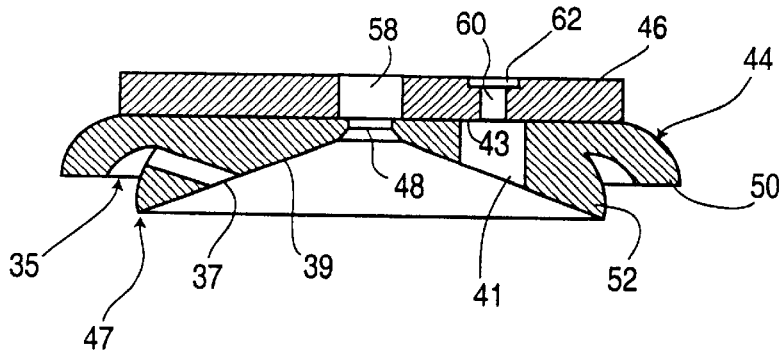
FIG. 6*a* is a cross sectional elevation of the plunger and plunger plate of the dispenser shown in FIG. 1.
Figure 6B:
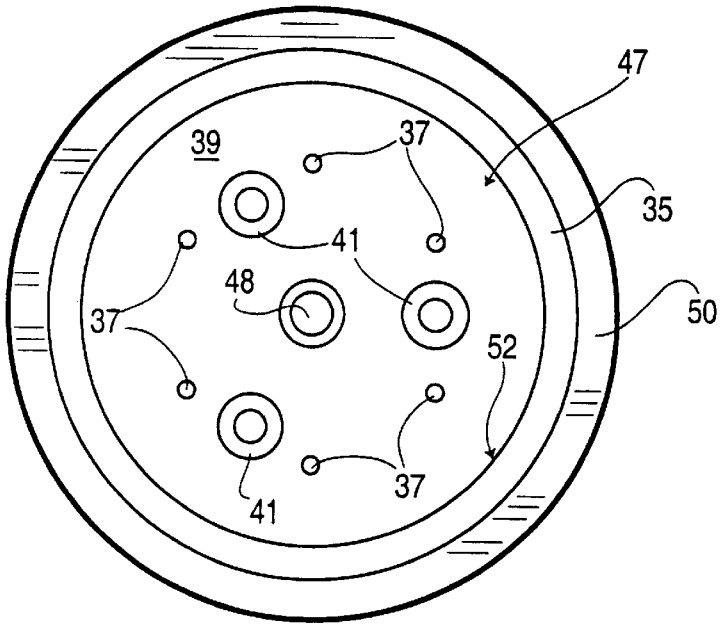
FIG. 6*b* is a bottom view of the plunger of FIG. 6*a*.

FIGS. 6*a* to 6*b* illustrate a preferred structure of the plunger in combination with the plunger plate 46. As shown in FIG. 6*a,* the plunger 44 comprises a disk having a generally conical internal structure, or funnel portion 47, and an upper surface 45 abutting against, and preferably attached to, the plunger plate 46. The downwardly depending outer edge 50 of the plunger acts as a wiper acting against the inner surface of the container 14 (not shown in FIG. 6). The funnel portion 47 of the plunger 44 includes an outer edge 52 that is separated from the plunger edge 50 by a space 35. As will be understood by persons skilled in the art, in situations where the container is tapered to a narrower diameter at its base, once the plunger 44 is advanced to the bottom of the container 14, the plunger edge 50 will be pressed into the space 35, so as to abut the outer edge 52 of the funnel portion. To aid this process, the outer edge 52 of the funnel portion 47 is preferably provided with a plurality of relief vent holes 37 to allow escape of air or ink there-through as the plunger edge 50 is brought there-against. Such vent holes 37 are also illustrated in FIG. 6*b*. The plunger is preferably made of a rigid but resilient material. In such manner, the plunger edge 50 is resilient enough to sealingly engage the interior surface of the container being emptied, throughout any taper in such container, while being rigid enough to prevent escape of any fluid through such sealing engagement.

As illustrated in FIG. 6*a*, the inner surface 39 of the plunger 44 has a concave, preferably conical shape. Such shape serves to aid in directing the fluid within the container towards the central aperture 48 as the plunger is advanced through the container. As also illustrated in FIG. 6*b*, the plunger 44 is further preferably provided with a plurality of cavities 41, which are used to house locking nuts to secure the plunger and plunger plate assembly to the drive system as will be described further below.

Figure 6C:
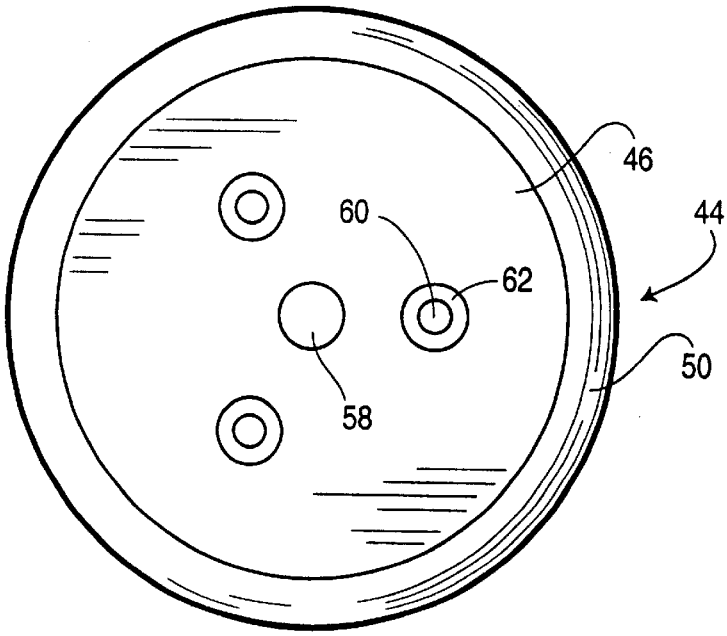
FIG. 6*c* is a top view of the plunger and plunger plate of FIG. 6*a*.
Figure 7:
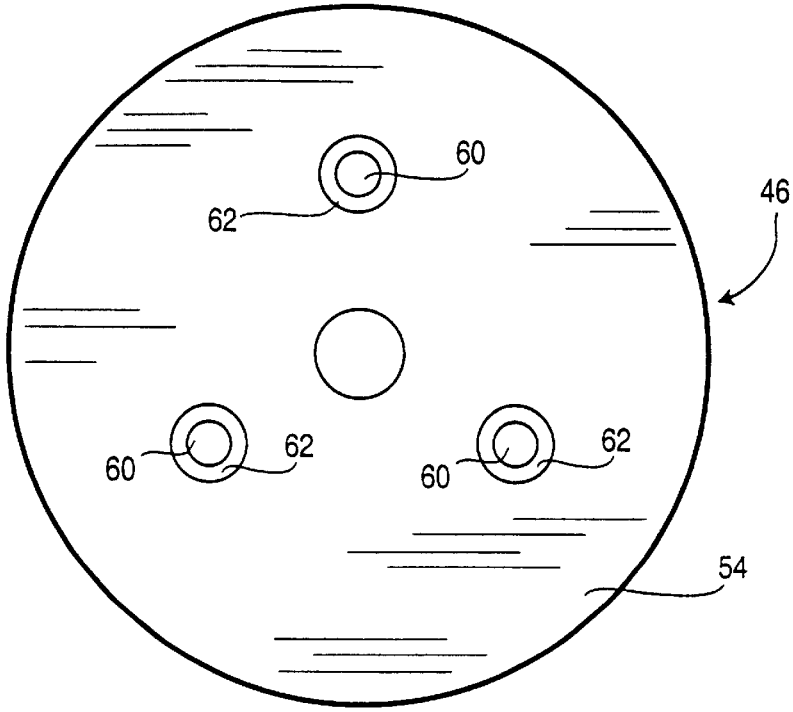
FIG. 7 is a top view of the plunger plate of the dispenser shown in FIG. 1.
Figure 8:
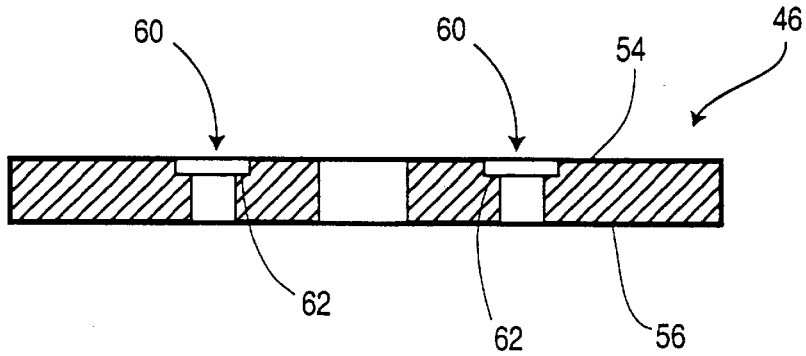
FIG. 8 is a cross sectional elevation of the plunger plate of the dispenser shown in FIG. 1.

FIGS. 6, 7 and 8 illustrate the plunger plate 46. As shown, the plate 46 generally comprises a circular disk having an upper surface 54, upon which a downward force is applied, and a lower surface 56, which bears against the plunger 44. The plunger plate is provided with a central aperture 58, which is co-axial with the central apertures of the plunger 44 and the cap 32. The plate 46 further includes a plurality of apertures 60 each having a ledge 62. The apertures are adapted to receive push rods 64 as will be described below.

As illustrated in FIG. 1, the hose 49 extends through the central apertures in the cap 32 and the plunger plate 46 and permits the ink being forced out by the plunger 44 to pass through.

FIG. 1 illustrates a number of push rods 64 connected, at their bottom ends 66, to the plunger plate 46. As indicated above, the bottom ends 66 of the push rods 64 are received within the apertures 60 in the plunger plate 46. The push rods 64 may be secured to the plunger plate 46 in a number of ways. In one embodiment, the push rods 64 are provided with threaded bolt ends 68 as shown in FIG. 1, that extend through the apertures 60 in the plunger plate, as more clearly shown in FIGS. 6 and 7. The bottom ends 66 of the push rods 64 preferably abut the ledges 62 provided on the plunger plate so as to prevent the push rods from passing therethrough. To secure the push rods 64 to the plunger plate 46, nuts (not shown) are used to fasten the bolt ends 68 of the push rods to the plunger plate 46. The cavities 41 in the plunger (as illustrated in FIGS. 6*a* and 6*b*) serve to house the nuts. As illustrated in FIG. 6*a*, the nuts bear against the plunger plate 46 at a surface 43. Various other means of attaching the push rods 64 to the plunger plate 46 will be apparent to persons skilled in the art.

The upper ends 70 of the push rods 64 are connected to a screw nut 72. The connection of the push rods to the screw nut may be achieved in the same manner as the connection with the plunger plate or any other manner. That is, the top ends of the push rods 64 may be provided with bolt ends similar to bolt ends 68 described above, and nuts can be used to secure such ends to the screw nut 72. Again, various other attachment means may be used. The push rods 64 slidably extend through the top plate 13.

Figure 9:
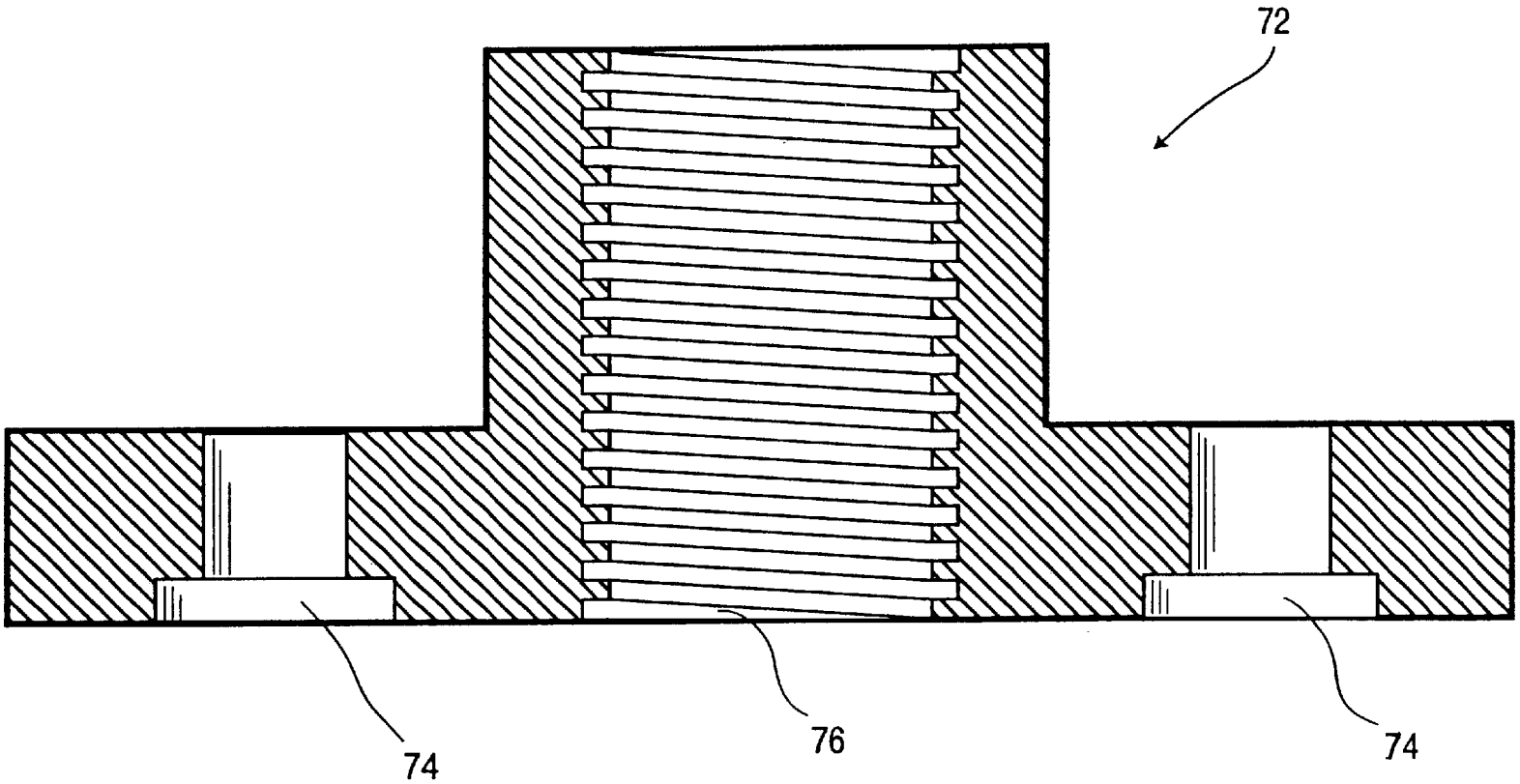
FIG. 9 is a cross sectional elevation of the screw nut of the dispenser shown in FIG. 1.

The screw nut 72 is illustrated in FIG. 9. As shown, the screw nut 72 includes apertures 74 to receive the push rods 64. The screw nut 64 also includes a threaded central aperture 76.

The screw nut 72 cooperates with a screw rod 78 having a lower end 80 rotatably secured to the top plate 13. A bearing 82 is preferably provided to facilitate axial rotation of the screw rod 78 with respect to the top plate 13. The upper end 84 of the screw rod 78 is connected to a motor 86. Jaw couplings 88 are preferably used to achieve the connection between the screw rod 78 and the motor 86. The connection may also include a bearing 90 and a bearing housing 92 as will be known to persons skilled in the art.

In the preferred embodiment, springs 93 are provided on each of the push rods. The springs 93 bear against the top plate 13 and the cap 32. In this manner, the springs 93 serve to maintain a downward force on the cap 32.

As shown in FIG. 1, the screw nut 72 and screw rod 78 may be contained within a sleeve 94 in order to prevent any moving parts of the dispenser from being exposed.

The operation of the dispenser will now be described with reference to the structural elements described above. Firstly, a container 14 containing the desired ink is placed within the sleeve 16 and both components are placed on the base 12. As mentioned above, the structure of the base serves to position the container and sleeve to prevent any sliding. Next, a suitably sized plunger 44 is chosen and secured to a suitable plunger plate 46. As will be apparent to persons skilled in the art, the size, that is diameter, of the plunger 44 will depend upon the diameter of the container 14 to be emptied. Once this is chosen, the appropriate plunger plate can then be attached. The plunger assembly (that is the plunger and the plunger plate) is then inserted into the cap 32 and the plunger and cap assembly is then secured to the push rods 64 by securing the nuts to the bolt ends 68 of the push rods as described above. In this way, the plunger portion of the device of the invention is attached to the drive means.

Next, the plunger and cap assembly comprising elements 44, 46 and 32 is lowered until the cap 32 engages the upper edge of the opening of the container 14. At this point the motor is activated thereby causing rotation of the screw rod 78. Such rotation in turn causes the screw nut, and the push rods 64 connected thereto, to be lowered. The downward movement of the push rods 64 in turns forces the plunger plate 46, and the plunger 44 attached thereto to be lowered. In this manner, the plunger applies a downward force against the ink or other fluid contained within the container 14. Such force causes pressure to build within the container and, therefore, expulsion of the ink through the central aperture 48 in the plunger 44 and, finally, through the hose 49. The outlet end of the hose 49 may then be directed to any desired receiving container.

Once the container is emptied, the motor is reversed to raise the plunger out of the spent container and a new container containing ink is replaced in the dispenser. As will be appreciated by persons skilled in the art, the springs 93 serve to maintain the cap on the container 14 and also to maintain the container on the base 12 during withdrawal of the plunger 44. As will also be appreciated, the raising of the plunger assembly is achieved by securing the plunger 44 and plunger plate 46 to the push rods 64.

Persons skilled in the art will appreciate that while the plunger, and especially the outer wiping edge 50 is preferably made of a resilient material, the remaining parts of the apparatus of the invention is preferably made of a rigid and sturdy material, such as metal. By way of example, such a rigid material is used to make the plunger plate 46, whereby, such plate offers the required support for the plunger 44 during the pumping process.

As will be apparent to persons skilled in the art, dispensing of the desired fluids (i.e. inks) may not necessarily be constant. That is, certain quantities of the ink may be needed at certain times. For this reason, the motor of the invention may be controlled by any means commonly known in order to dispense the desired amount of ink. Such controllers may comprise a simple switch mechanism or a microprocessor based system. In an alternative embodiment, the motor can be provided with a simple switch to turn it on or off.

In addition, a dispensing system may include a plurality of the above described dispensers. For example, in one embodiment of the invention, a number of dispensers, each having ink of a different colours, may comprise a dispensing system. In such manner, desired quantities of any colour may be individually controlled. Further, a system incorporating multiple dispenser units may be microprocessor controlled with each preferably coupled with a variable frequency drive. In such manner, each of the dispensers is highly controllable.

Although the above description has been directed to the embodiment of dispensing plastisol inks and other viscous fluids, it will be appreciated by persons skilled in the art that the dispenser and system of the present invention would be applicable to any type of fluid.

It will also be apparent to persons skilled in the art that the screw mechanism by which the plunger is advanced offers a high level of control in dispensing the desired amounts of the fluid. Such screw mechanism can be driven by any known means such as an electric motor, a hydraulic motor, or an air motor.

In another embodiment, the screw mechanism can be replaced with a hydraulic ram. Other means to advance the plunger will be apparent to persons skilled in the art.

In yet another embodiment, the plunger plate 46 may be integral with the plunger 44. Further, although the plunger plate is preferably made of a metal, it can also comprise any rigid material that offers the required support to the plunger.

In yet another embodiment, the dispenser described above can be used to fill containers by operating the unit in reverse. Specifically, by beginning the plunger in the lowered position, that is adjacent to the bottom of the container, and withdrawing same, a vacuum is developed within the container. Such vacuum can then draw fluid into the container through the hose.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. An apparatus for dispensing a viscous fluid, such as plastisol ink, from a generally cylindrical container containing such fluid, said apparatus comprising:

a frame including a base for supporting the container, and a platform for supporting a plunger mechanism, said platform being generally vertically separated from said base;

the plunger mechanism including a plunger and a microprocessor controlled drive mechanism for advancing said plunger towards said container and for impinging on said fluid;

said plunger being adapted to sealingly engage the interior wall of said container; and, said plunger including an exit port there-through for allowing ejection of said fluid from said container as said plunger is advanced into the container.

2. The apparatus of claim 1 wherein said plunger includes a funnel portion having a concave fluid contacting surface for directing said fluid to said exit port.

3. The apparatus of claim 2 wherein said concave surface is generally conical.

4. The apparatus of claim 2 wherein said plunger includes a resilient wiping edge separated from said funnel portion.

5. The apparatus of claim 4 wherein said plunger further includes a support plate on an upper side thereof.

6. The apparatus of claim 1 further including a hose connected to said exit port for channeling said fluid.

7. The apparatus of claim 1 further including a sleeve for supporting the side of said container.

8. The apparatus of claim 1 wherein said base for supporting the container includes a recess for receiving the base of said container.

9. The apparatus of claim 1 wherein said drive mechanism includes one or more advancing arms each having first and second ends, said first ends being attached to said plunger and said second ends being attached to an advancing mechanism.

10. The apparatus of claim 9 wherein said advancing mechanism includes:

a threaded screw rod, secured in a generally vertical position to said frame and being rotatable about its central axis;

a nut having a correspondingly threaded aperture for engaging said screw rod and being capable of traversing along the length of said screw rod as said screw rod is rotated;

said nut being attached to said second ends of said advancing arms;

and a motor for rotating said screw rod;

whereby as said screw rod is rotated by said motor, said nut is raised or lowered.

11. A system for dispensing a viscous fluid comprising a plurality of apparatus as claimed in claim 10.

12. The apparatus of claim 9 wherein said advancing mechanism comprises a hydraulic ram.

13. A system for dispensing a viscous fluid comprising a plurality of apparatus as claimed in claim 1.

14. An apparatus for dispensing a viscous fluid, such as plastisol ink, from a generally cylindrical container containing such fluid, said apparatus comprising:

a frame including a base for supporting the container, and a platform, generally vertically separated from said base, for supporting a plunger mechanism;

the plunger mechanism including a plunger and a drive mechanism for advancing said plunger towards said container and for impinging on said fluid;

said plunger being adapted to sealingly engage the interior wall of said container; and, said plunger including an exit port there-through for allowing ejection of said fluid from said container as said plunger is advanced into the container;

wherein said drive mechanism includes one or more advancing arms each having first and second ends, said first ends being attached to said plunger and said second ends being attached to an advancing mechanism and wherein said advancing mechanism includes:

a threaded screw rod, secured in a generally vertical position to said frame and being rotatable about its central axis;

a nut having a correspondingly threaded aperture for engaging said screw rod and being capable of traversing along the length of said screw rod as said screw rod is rotated;

said nut being attached to said second ends of said advancing arms;

and a motor for rotating said screw rod;

whereby as said screw rod is rotated by said motor, said nut is raised or lowered.

15. The apparatus of claim 14 wherein The apparatus of claim 1 wherein said plunger includes a funnel portion having a concave fluid contacting surface for directing said fluid to said exit port.

16. The apparatus of claim 15 wherein said concave surface is generally conical.

17. The apparatus of claim 15 wherein said plunger includes a resilient wiping edge separated from said funnel portion.

18. An apparatus for dispensing a viscous fluid, such as a plastisol ink, from a generally cylindrical container containing such fluid, said apparatus comprising:

a frame means for supporting said container;

a plunger means, supported on said frame means, for applying pressure to said fluid in said container for forcing said fluid out of said container and through a port in said plunger means; and a drive means, supported on said frame means, for advancing said plunger means, said drive means being controlled by a microprocessor.

* * * * *